US006629821B1

(12) United States Patent
Yokota et al.

(10) Patent No.: US 6,629,821 B1
(45) Date of Patent: Oct. 7, 2003

(54) PUMP APPARATUS

(75) Inventors: Hiroshi Yokota, Hiroshima (JP); Shingo Yokota, Hiroshima (JP); Tetsuya Tanimoto, Hiroshima (JP)

(73) Assignee: Kabushiki Kaisha Yokota Seisakusho, Hiroshima-Ken (JP)

( * ) Notice: Subject to any disclaimer, the term of this patent is extended or adjusted under 35 U.S.C. 154(b) by 0 days.

(21) Appl. No.: 10/030,063

(22) PCT Filed: Jul. 5, 2000

(86) PCT No.: PCT/JP00/04508

§ 371 (c)(1),
(2), (4) Date: Jan. 4, 2002

(87) PCT Pub. No.: WO01/02732

PCT Pub. Date: Jan. 11, 2001

(30) Foreign Application Priority Data

Jul. 5, 1999 (JP) ..... 11-190284

(51) Int. Cl.[7] ..... F04B 23/08

(52) U.S. Cl. ..... 417/199.1; 417/312; 95/242; 95/261; 96/214; 96/217; 96/177

(58) Field of Search ..... 417/119.1, 312; 95/242, 261; 96/214, 217, 177

(56) References Cited

U.S. PATENT DOCUMENTS 3,973,930 A * 8/1976 Burgess ..... 95/261
4,201,555 A * 5/1980 Tkach ..... 95/15
4,326,863 A * 4/1982 Day et al. ..... 96/182
4,435,193 A * 3/1984 Gullichsen et al. ..... 95/19
4,919,826 A * 4/1990 Alzner ..... 210/788
4,921,400 A * 5/1990 Niskanen ..... 415/169.1
5,622,621 A * 4/1997 Kramer ..... 210/188
5,711,789 A * 1/1998 Elonen et al. ..... 96/216
6,152,689 A * 11/2000 Yokota et al. ..... 415/56.1
2002/0127167 A1 * 9/2002 Satchell et al. ..... 423/383

FOREIGN PATENT DOCUMENTS

| | | |
|---|---|---|
| JP | 40-3655 B1 | 2/1965 |
| JP | 42-3145 B1 | 2/1965 |
| WO | 98/04833 | 2/1998 |

* cited by examiner

*Primary Examiner*—Charles G. Freay
*Assistant Examiner*—William H. Rodriquez
(74) *Attorney, Agent, or Firm*—Ladas & Parry

(57) ABSTRACT

The present invention provides a multipurpose pump apparatus of high achievement, which can continuously pump and convey liquid even containing a large amount of foams and can make high level defoaming function and degassing function, and pumped liquid sterilizing function, etc. The pump apparatus comprises a gas-liquid separating impeller disposed in a pumped liquid path of a primary pump for pumping liquid, a cavity receiver which receives the tail bottom of a tornado-shaped cavity produced by the rotation of the gas-liquid separating impeller to prevent the tornado-shaped cavity from extending, and vacuum means connected to a part in a vicinity of the center of the tornado-shaped cavity through a degassing path.

19 Claims, 12 Drawing Sheets

PUMP APPARATUS

BACKGROUND OF THE INVENTION

1. Field of the Invention

The present invention relates to a pump apparatus for multiple purposes, which can continuously pump and transfer liquid even containing a large amount of foams, but also can make high-level defoaming function, degassing function, pumped liquid sterilizing function, etc.

2. Description of the Prior Art

It is generally thought difficult to pump and transfer liquid containing a large amount of foams with pumps. Specifically centrifugal pumps have a problem that they do not find it easy to continuously pump and transfer such liquid while removing the foams even in use together with vacuum means for degassing.

The art which has clearly solved this problem is the invention "a centrifugal pump" described in the specification of Japanese Patent Publication No. 3655/1965. (This invention will be hereinafter called "Original Invention 1".) In Original Invention 1, a primary pump for pumping liquid is equipped with a sub-pump for drawing a cavity, which has a suction port disposed in communication with a vicinity of the center of the impeller of the primary pump and a discharge port in communication with the suction port of the primary pump, and a degassing path is provided from a vicinity of the center of the impeller of the sub-pump to the vacuum means, whereby a cavity in the vicinity of the center of the impeller of the primary pump is forcedly removed so as to keep the pumped liquid always uninterrupted.

An improvement of Original Invention 1, in which a safety valve which is opened and closed by a negative pressure generated by the vacuum means which is inserted in the degassing path so as to prevent malfunctions of the vacuum means due to intrusion of the pumped liquid during a pause of the pump is the invention "a self-priming centrifugal pump" described in the specification of Japanese Patent Publication No. 3145/1967. (This invention will be hereinafter called "Original Invention 2".)

An improvement of Original Invention 2, in which safety means, such as a valve mechanism or others, comprising a delayed operating valve, a quick valve, etc. is inserted in the degassing path, whereby the intrusion of liquid into the vacuum means from the primary pump can be securely prevented throughout all the processes of pump actuation, operation and stop is the invention "a self-priming centrifugal pump" described in the specification of International Publication WO98/04833 (International Application PCT/JP97/00857). (This invention will be hereinafter called "Original Invention 3".)

As exemplified in FIG. 12, the pump apparatus according to Original Invention 3 comprises a primary pump 1, a sub-pump 4 and vacuum means 12. A vicinity of the center of the primary pump impeller 2 is in communication with the suction port c of the sub-pump 4. The sub-pump discharge port d is in communication with the primary pump suction port a through a return flow path e. A vicinity of the center of the sub-pump impeller 5 is connected to the vacuum means 12 through a degassing path h. In the degassing path h, a delayed operating valve 13 which is opened at a lag from a time upon injection of a power input of the motor of the pump apparatus and a quick valve 14 which is closed immediately upon turn-off of the power of the motor are serially inserted. In the pump apparatus shown in FIG. 12, wherein the vacuum means 12 is provided by a fluid ring vacuum pump. The delayed operating valve 13 is opened at a delayed time by an internal pressure in the valve drive chamber w gradually increasing as a hydraulic pressure of the operational fluid of the fluid ring vacuum pump is increased.

The pump apparatus shown in FIG. 13 is proposed as one embodiment of original Invention 3. In this pump apparatus, a communication passage from a vicinity of the center of the impeller 2 of the primary pump to the suction port c of the sub-pump is open to a part where a cavity is generated, on the suction side of the primary pump impeller 2, a helical inlet is formed on the suction side of the primary pump impeller 2, and a smaller-bore impeller 23 which is rotated, interlocked with the primary pump is provided, so as to draw the gas in the cavity with a shape as defined by the dot line in FIG. 13 formed on the suction side of the primary pump impeller 2.

The pump apparatus of Original Invention 3 can easily suck liquid containing a large amount of foams, slurries, etc., also can prohibit intrusion of the liquid from the primary pump into the vacuum means throughout all the processes of actuation, operation and stop of the pump, and can be completely automatically operated and is a very practically useful device. However, the pump apparatus still has a problem to be solved. The problem is its gas-liquid separation which can be used in simply pumping liquid but is insufficient in higher-level applications, e.g., higher-level defoaming, degassing for extruding gas dissolved in the pumped liquid, etc.

For advancing the gas-liquid separation, specifically for removing gas dissolved in the pumped liquid, it is known to dispose a resisting object, such as an orifice or others, in the flow path to decompress the pumped liquid, or to raise the temperature of the pumped liquid. However, what is important is how to perfectly trap the gas which has been separated, so that the gas can be perfectly separated from the pumped liquid. For higher defoaming and degassing achievements, the vacuum means must be accordingly efficient, which means the pumped liquid tends to be drawn, with mixed gas, into the vacuum means. Accordingly, the gas-liquid separation must be sufficiently made before the degassing.

In the pump apparatus of original Invention 3, basically a centrifugal force for the gas-liquid separation is generated by rotation of the primary pump impeller 2. However, concurrently therewith, strong vortexes and turbulent flows are produced, and a part of foams cannot be centrifuged for separation and will be entrained on the vortexes and turbulent flows of the pumped liquid and go out to the primary pump discharge port b. Thus the gas-liquid separation is not always sufficient. Even in the pump apparatus shown in FIG. 13, comprising the smaller-bore impeller 23 rotatably interlocked with the primary pump impeller 2, the smaller-bore impeller 23 only plays the role of retaining a cavity unbroken, which is produced by the helical inlet on the suction side of the primary pump impeller 2. Also in the primary pump impeller 2, a part of the foams which has escaped the centrifugation will be entrained on the pumped liquid to be carried to the primary pump discharge port b.

As the generally used conventional art, the cyclone-type gas-liquid separating mechanism comprising the helical inlet is widely used. The mechanism depends on whirling force generated by kinetic energy of the pumped liquid itself and cannot make sufficient gas-liquid separation.

SUMMARY OF THE INVENTION

An object of the present invention is to provide a multi-purpose pump apparatus of high achievement which can solve by a simple constitution the problem still left unsolved by Original Invention 3, and which incorporates a gas-liquid separation mechanism, etc. stably and without failure operative to make high-level defoaming function and degassing function and further pumped liquid sterilizing function, etc.

To attain the above-described object the pump apparatus according to the present invention comprises a gas-liquid separating apparatus with a gas-liquid separating impeller being inserted in a pumped liquid flow path of a primary pump for liquid pumping; a cavity receiver receiving the tail bottom of a tornado-shaped cavity produced by rotation of the gas-liquid separating impeller to prevent the tornado-shaped cavity from extending; and vacuum means connected to a part in a vicinity of the center of the tornado-shaped cavity through a degassing path.

A pump apparatus according to another invention comprises a gas-liquid separating impeller disposed in a pumped liquid flow path of a primary pump for liquid pumping with a primary pump impeller; a cavity receiver receiving the tail bottom of a tornado-shaped cavity produced by rotation of the gas-liquid separating impeller to prevent the tornado-shaped cavity from extending; and vacuum means connected to a part in a vicinity of the center of the tornado-shaped cavity through a degassing path.

In the present invention, a part in a vicinity of the center of the primary pump impeller may be also connected to the vacuum means through a degassing path;

- the primary pump impeller and the gas-liquid separating impeller may be disposed adjacent to each other;
- a flow path on the suction side of the gas-liquid separating impeller may be formed in a shape by which a liquid is drawn into a direction of rotation of the gas-liquid separating impeller;
- throttle means for decompressing a pumped liquid may be inserted in the flow path on the suction side of the gas-liquid separating impeller;
- heating means for the pumped liquid may be inserted in the flow path on the suction side of the gas-liquid separating impeller;
- cavitation causing means may be disposed in the pumped liquid flow path;
- constituent members of the primary pump may be formed in a configuration which tends to cause cavitation;
- the gas-liquid separating impeller may be formed in a configuration which tends to cause the cavitation;
- breaking means for breaking foreign objects in the pumped fluid may be further disposed;
- protection means which allows gas to pass but prevent liquid from passing may be inserted in the degassing path;
- a sub-pump including an impeller may be disposed; the degassing path may be in communication with the suction port of the sub-pump; the discharge port of the sub-pump may be in communication with the suction side of the primary pump through a return path; and a part in a vicinity of the center of the sub-pump impeller may be in communication with the vacuum means;
- valve means which is opened at a lag from a time when an operating power of the sub-pump is injected and closes immediately at a time when the driving force of the sub-pump is shut off may be inserted in the degassing path;
- the discharge port of the vacuum means may be in communication with the discharge side of the primary pump through a return path;
- at least two of the primary pump, the gas-liquid separating impeller, the sub-pump and the vacuum means may be coaxial with one rotary shaft system; and
- the gas-liquid separating impeller and the cavity receiver may be disposed in multi-stages.

Because of such constitution, in the pump apparatus according to the present invention, when liquid is pumped by the primary pump, foams in the pumped liquid are forcedly centrifuged by the gas-liquid separating impeller, a tornado-shaped cavity produced near the center of the gas-liquid separating impeller has the tail bottom received by the cavity receiver to be prevented from extending, the gas is drawn by the vacuum means from a part in a vicinity of the center of the cavity through the degassing path, whereby strong defoaming function can be made.

Gas dissolved in the pumped liquid is separated by decompression or others, and the generated foams are forcedly centrifuged by the gas-liquid separating impeller. Thus, strong degassing function is made.

Cavitation is caused in the pumped liquid after degassed, whereby sterilizing function, etc. can be made.

The intrusion of the pumped liquid into the vacuum means is prevented, whereby safe control of the pump apparatus can be perfect, and foreign objects in the pumped liquid can be broken. The pump apparatus can be easily applied to various applications.

DESCRIPTION OF THE PREFERRED EMBODIMENTS

Embodiment of the present invention will be explained in good details by giving the same reference numbers to parts which are common throughout the drawings.

Figure 1:
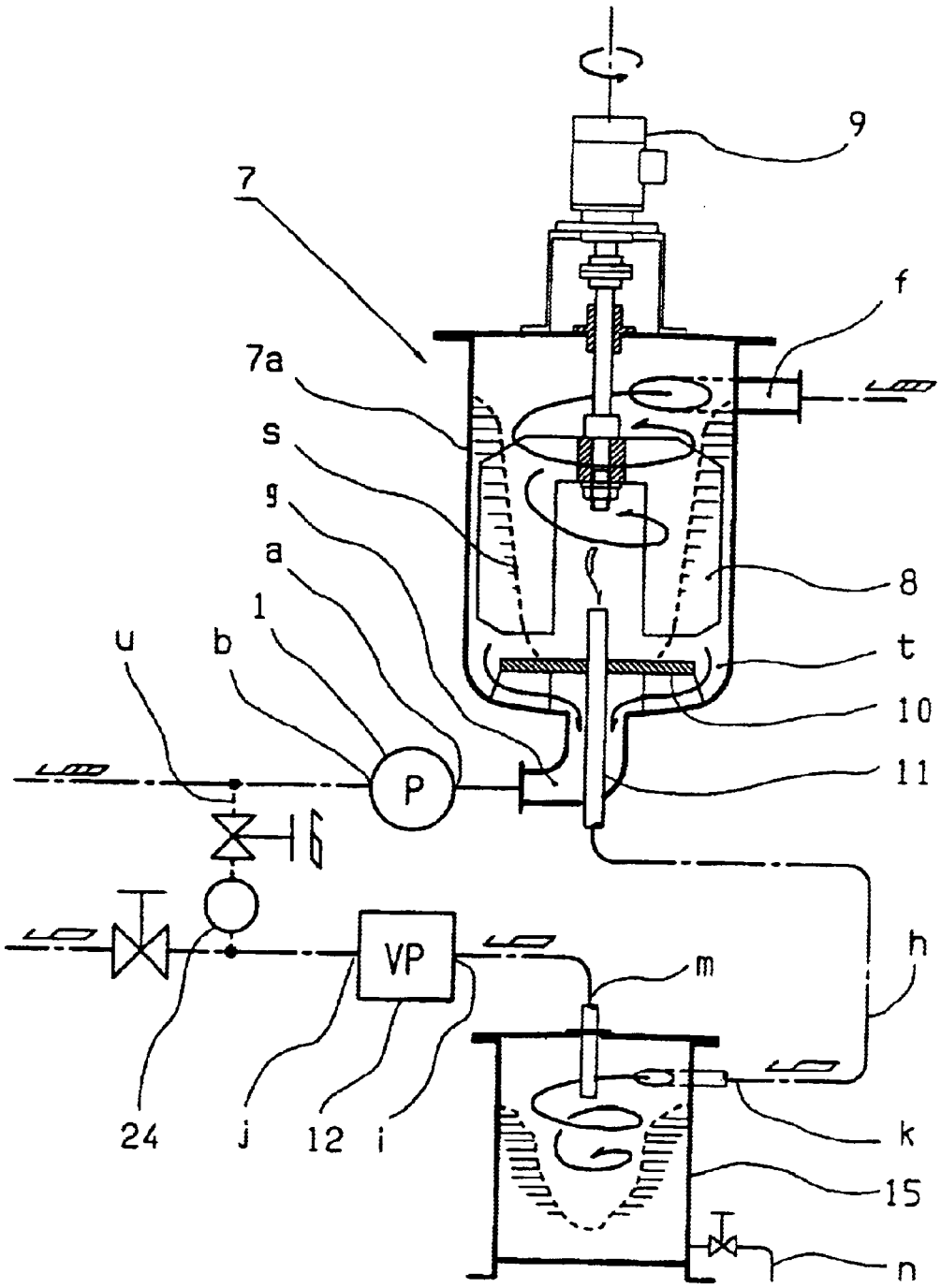
FIG. 1 is a vertical sectional view (partially a side view) of the pump apparatus according to a first embodiment of the present invention.

A first embodiment of the present invention shown in FIG. 1 exemplifies one application of the pump apparatus according to the present invention to a defoaming pump. A gas-liquid separating apparatus 7 is inserted in the flow path of a primary pump 1 for pumping liquid on the suction side. A gas-liquid separating impeller 8 having a suitable number of vanes is disposed in a gas-liquid separating apparatus vessel 7*a* having an inlet f and an outlet g. The gas-liquid separating impeller 8 has an outer diameter which allows a small gap between the gas-liquid separating impeller 8 and the inside wall of the vessel 7*a*, and is rotated by a motor 9 through a shaft put through the vessel 7*a*, tightly sealing the vessel 7*a*. In the gas-liquid separating apparatus there is also disposed a cavity receiver 10 which receives the tail bottom of a tornado-shaped cavity s produced by the rotation of the gas-liquid separating impeller 8 to prevent the tornado-shaped cavity s from extending to be drawn into the primary pump 1. A gap t between the outer circumference of the cavity receiver 10 and the inside wall of the vessel 7*a* is narrowed to have a flow path area which admits the pumped liquid pressed on the inside wall of the vessel 7*a* by a centrifugal force generated by the rotation of the gas-liquid separating impeller 8. A degassing pipe 11 for discharging cavity gas is disposed in a vicinity of the center of the tornado-shaped cavity s. The degassing pipe 11 is connected to vacuum means 12 through a degassing path h. The vacuum means 12 may be a liquid ring vacuum pump or other type-vacuum pumps, or negative pressure generating means.

When the pump apparatus according to the first embodiment is operated, pumped liquid is led from the inlet f of the gas-liquid separating apparatus 7 to the outlet g thereof by the pumping action of the primary pump 1. Meanwhile, foams in the pumped liquid are forcedly centrifuged by the rotation of the gas-liquid separating impeller 8, and the tornado-shaped cavity s in the form indicated by the dot line in the drawing is produced in the vicinity of the center of the gas-liquid separating impeller 8. The tornado-shaped cavity s is prevented by the cavity receiver 10 from extending to have the tail bottom drawn into the primary pump 1. The cavity gas is drawn by the vacuum means 12 through the degassing pipe 11 disposed in the vicinity of the center of the tornado-shaped cavity s and the degassing path h, and is discharged to the outside of the pump apparatus system through a discharge port j of the vacuum means 12.

This gas-liquid separating process is carried out by means of a strong centrifugal force generated by forcedly rotating the pumped liquid by the gas-liquid separating impeller 8, and the extension of the tail bottom of the cavity is prevented by the cavity receiver 10, whereby in comparison with the simple cyclone-type, etc., the cavity has less liquid, and is of higher quality. Furthermore, liquid is rotated along the inside wall of the vessel 7*a* and then is preferentially passed through the gap t restricted between the cavity receiver 10 and the vessel 7*a*, whereby it is less possible for foams to pass the gap t, and thus the forced defoaming can be performed.

In FIG. 1, the gas-liquid separating apparatus 7 is inserted in the flow path on the suction side of the primary pump 1, but depending on conditions of the use, may be inserted in the flow path on the discharge side. The pumped liquid is forcedly gas-liquid separated by the gas-liquid separating impeller 8, but it is of course more preferable that the gas-liquid separating apparatus inlet f is configured so that the liquid in the flow path of the inlet f is drawn in the direction of rotation of the gas-liquid separating impeller 8. FIG. 1 shows the inlet f of such configuration.

In FIG. 1, reference number 15 indicates protection means which, when the pumped liquid is mixed in gas passing the degassing path h, prohibits the pumped liquid from passing while admitting the gas alone to pass to the vacuum means 12. The protection means is exemplified by the protection means of liquid reservoir type, which comprises an inlet k disposed in an upper part of the vessel thereof and communicated with the gas-liquid separating apparatus 7, and an outlet m to the vacuum means 12, so that the pumped liquid which has intruded from the gas-liquid separating apparatus 7 into the means remains at the bottom of the vessel while the gas alone is passed through the means. For higher gas-liquid separating efficiency, it is more preferable that the flow path of the inlet k is tangential to the inside wall of the vessel so as to generate the centrifugal effect. In an emergency that, for example, the gas-liquid separating apparatus 7 should insufficiently operate, the protection means 15 prohibits the pumped liquid from intruding into the vacuum means 12 for the safety of the apparatus. A drain n for discharging the reserved liquid is disposed in a lower part of the vessel. The discharging operation through the drain n may be manual, or may be automatic to discharge the reserved liquid which has reached a prescribed amount. Otherwise, the reserved liquid may be incessantly drained. It is possible that protection means which admits the gas to pass while prohibiting the liquid from passing is additionally inserted in the degassing path h.

In FIG. 1, it is shown by the dot line that the discharge port j of the vacuum means 12 may be communicated with the discharge side of the primary pump 1 through the return path u. This is for an application that liquid containing a large amount of foams is pumped, but should be pumped without removing the foams. In this application, first the defoaming is performed so as to enable the liquid to be pumped by the primary pump 1, and after the liquid has been pumped, the foams are mixed back into the pumped liquid so that the pumped liquid restores the original state. When a discharge pressure of the vacuum means 12 is lower than a discharge pressure of the primary pump 1, booster means 24, such as a compressor or others, can be inserted in the return path u for boosting the pressure.

Figure 2:
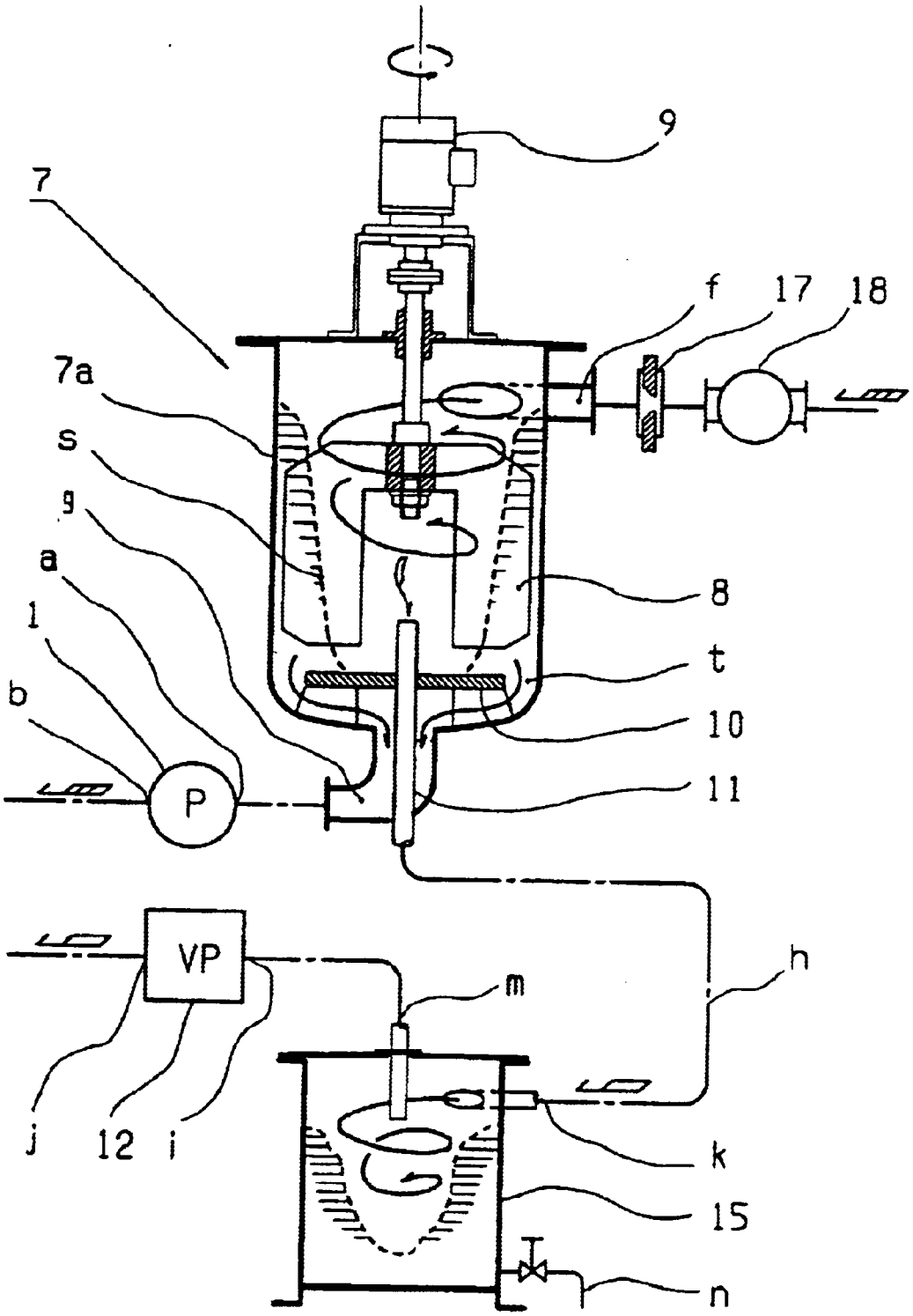
FIG. 2 is a vertical sectional view (partially a side view) of the pump apparatus according to a second embodiment of the present invention.

In a second embodiment shown in FIG. 2, the pump apparatus according to the present invention is applied to a degassing pump. Throttle means 17 (e.g., a fixed orifice in FIG. 2) for decompressing the pumped liquid is inserted in the flow path of the inlet f of the gas-liquid separating apparatus 7 according to the first embodiment.

It is known that when a flow of liquid is throttled for decompression, the so-called "degassing" phenomena that the gas dissolved in the liquid is separated into foams take place. In the second embodiment, foams separated from the pumped liquid by the decompression are forecedly centrigued by the gas-liquid separating means 7, and the remaining pumped liquid alone is fed into the primary pump 1, thus a strong degassing is carried out.

The applications of the pump apparatus according to the second embodiment range widely over various industrial fields, e.g., production of pure water and clean liquids, production of degassed boiler water for rust-proof, production of other degassed water, degassing oil, etc. A desired gas (e.g., ozone or others) may be added after the degassing.

Raising a temperature of the pumped liquid is useful to improve the degassing efficiency. FIG. 2 shows that heating means 18 for heating the pumped liquid may be inserted in the flow path of the gas-liquid separating apparatus inlet f. The heating means 18 can be suitably of heater-type, heat exchanger-type or other types.

The rest constitution and the operation are the same as those of the first embodiment, and their explanation will not be repeated.

Figure 3:
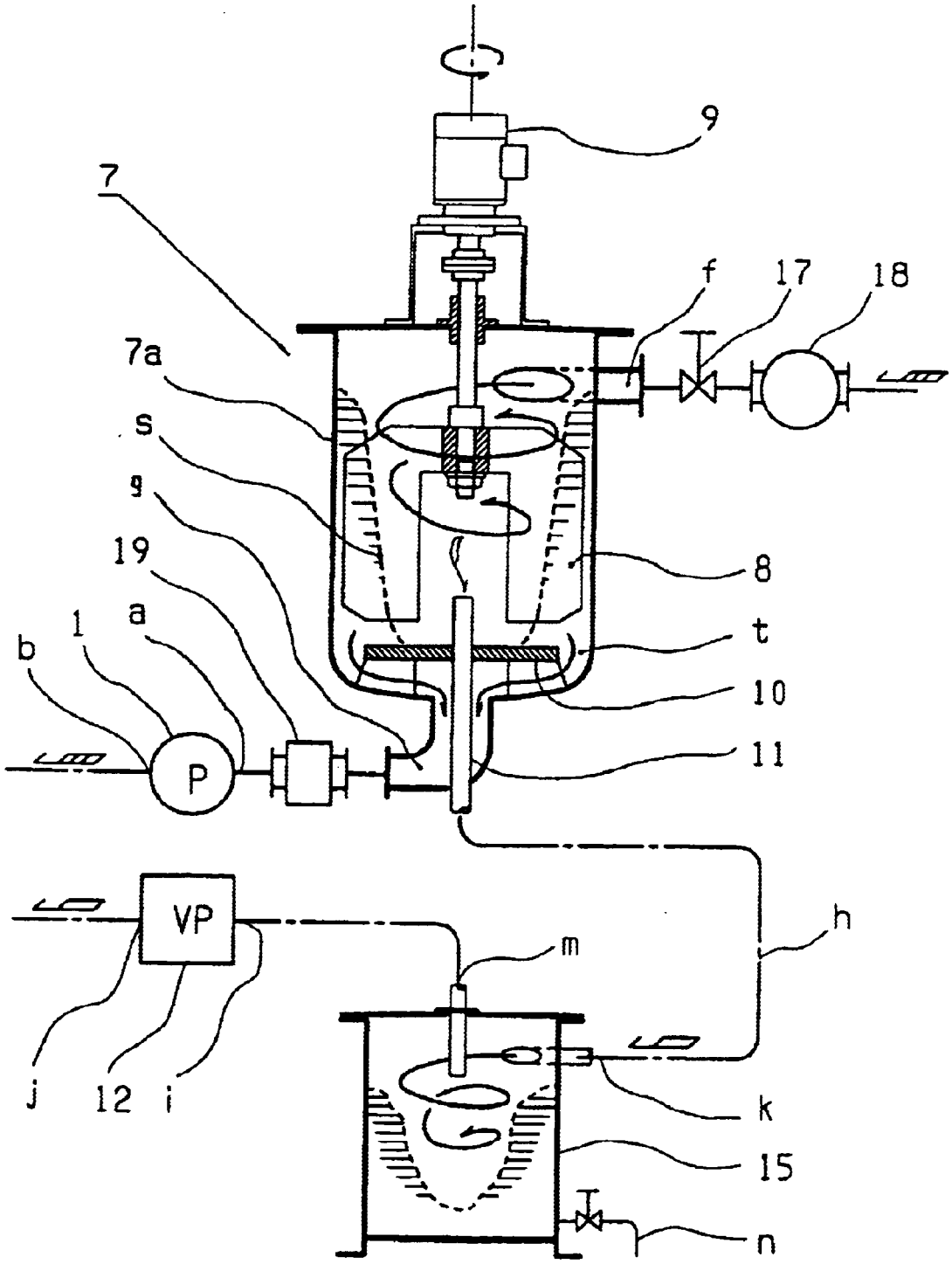
FIG. 3 is a vertical sectional view (partially a side view) of the pump apparatus according to a third embodiment of the present invention.

A third embodiment shown in FIG. 3 is an application to a pump having sterilizing function, etc. by cavitation. Cavitation means 19 is provided in the flow path of the pumped liquid of the primary pump 1 of the second embodiment.

It is known that when a pressure of liquid drops down to below a certain limit pressure (vapor pressure), "cavitation" phenomena of producing foams of the liquid itself take place. Conditions under which the cavitation tends to take place are, e.g., a sufficiently low pressure, a high temperature and pressure changes due to whirls and turbulent flows. When the vapor foams collapse, very high pressures (shock waves), e.g., of hundreds to one thousand atmospheric pressure and local high temperatures are produced.

Usually cavitation should be prevented because shock waves produced upon the collapse of the vapor foams are causes of achievement deterioration of fluid machines and instruments, cavitation damage, vibrations, noises, etc. In the third embodiment, however, oppositely the shock waves of the cavitation are positively utilized to physically destroy bacteria, i.e., have functions of sterilization, etc.

On the other hand, what is similar to the cavitation is "degassing", that, as described above, gas dissolved in liquid is separated in foams. The degassing is caused also by decompression, and is called "gas cavitation" and is often included in the cavitation. However, pressures produced upon the collapse of the foams are much lower than those produced upon the collapse of the vapor foams.

Usually, the degassing phenomena of dissolved gas being separated take place before the genuine cavitation phenomena that vapor foams of liquid are produced. When gas contents of cavitation vapor foams are resultantly increased, the gas functions as cushion when the vapor foams collapse to attenuate cavitation shock waves. This is unpreferable from the viewpoint of utilizing the cavitation. Then, in the third embodiment, before the pumped liquid is exposed to the cavitation causing means 19, gas separated by the degassing is removed to thereby minimize gas contents of the cavitation vapor foams, whereby the cavitation is caused to strongly act, making the effective sterilizing function.

The cavitation causing means 19 can be suitably of the known ultrasonic wave generating type or the type which causes the cavitation by rotating an impeller or others.

Applications of the third embodiment range widely over various industrial fields of producing pure water and clean liquid by sterilization, and also destroying and exterminating small organisms, such as weeds and moss, plankton and shell eggs, water improvement by cluster decomposition, pulverization of particles in liquid, deodorizing liquid, breaking compositions of impurities in liquid (by using high pressures and high temperatures due to the cavitation collapse), etc. The applications are not each exemplified here, but the present invention is practically characterized by basically utilizing the physical phenomena without using chemicals causing environmental pollution.

The throttle means 17 may be of fixed opening type, but if the throttle means 17 is of adjustable opening type, it is convenient in adjusting operations. In FIG. 3, the throttle means of the open/close valve type is exemplified.

The rest constitution and operations are the same as those of the second embodiment, and their explanation will not be repeated.

Figure 4:
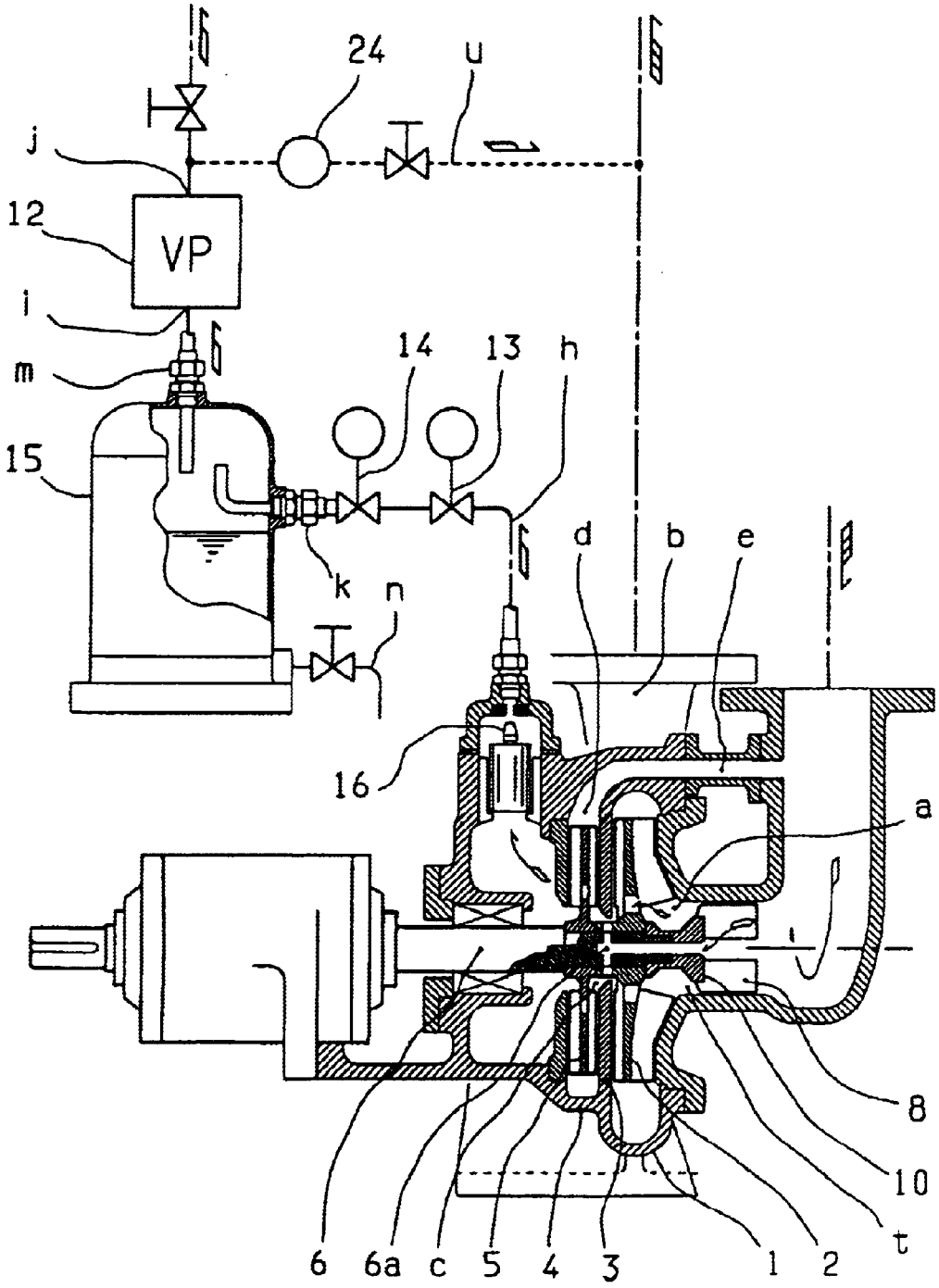
FIG. 4 is a vertical sectional view (partially a side view) of the pump apparatus according to a fourth embodiment of the present invention.

A fourth embodiment shown in FIG. 4 is the pump apparatus according to the first embodiment which is made more compact by replacing the primary pump 1 of the defoaming pump of the first embodiment by a centrifugal pump and integrating the centrifugal pump with the gas-liquid separating apparatus 7.

A gas-liquid separating impeller 8 having a suitable number of vanes is disposed adjacent to a primary pump impeller 2 for liquid pumping on the suction side, so that foams can be sufficiently separated before the pumping of the primary pump 1. The gas-liquid separating impeller 8 has an outer diameter which allows for a small gap with respect to the inside wall of the flow path and is rotated together with the primary pump impeller 2 through a main shaft 6. There is provided a cavity receiver 10 which receives the tail bottom of a tornado-shaped cavity produced by the rotation of the gas-liquid separating impeller 8 to thereby prevent the tornado-shaped cavity from extending to be drawn into the primary pump impeller 2. A gap t between the outer circumference of the cavity receiver 10 and the inside wall of the flow path is made small to a flow path area which admits the pumped liquid alone pressed on the inside wall of the flow path by a centrifugal force generated by the rotation of the gas-liquid separating impeller 8. The part in a vicinity of the center of the tornado-shaped cavity is connected to vacuum means 12 through a communication hole **6*a* formed in the main shaft 6** and a degassing path h.

The primary pump impeller 2 has the front side and the back side of the vicinity of the center communicated with each other through a hole, a slit or others, and has the part in the vicinity of the center communicated with the vacuum means 12 through a degassing path h.

The protection means which, when the pumped liquid is mixed in the gas passing through the degassing path h, prevents the pumped liquid from passing while permitting the gas alone to pass to the vacuum means 12 may be the same as the protection means 15 described in FIG. 1. The fourth embodiment exemplifies, as more ensuring means, the protection means of the sub-pump type based on the technical idea of Original Invention 3. That is, a sub-pump 4 having an impeller 5 is attached to the primary pump 1 with a spacer plate 3 therebetween. The sub-pump impeller 5 has the front side and the back side of the vicinity of the center communicated with each other through a hole, a slit or others. The sub-pump impeller 5 is so structured that its discharge ability (centrifugal force) can cope with a suction force (vacuum degree) of the vacuum means 12. The vicinity of the center of the primary pump impeller 2 and also the communication hole **6*a* communicated with the gas-liquid separating impeller 8 are in communication with a sub-pump suction port c. A passable amount of the sub-pump suction port c is set to be smaller than a dischargeable amount of the sub-pump impeller 5. A sub-pump discharge port d is in communication with the suction side of the primary pump through a return path e and the part in the vicinity of the center of the sub-pump impeller 5 is communicated with the vacuum means 12**.

The vicinity of the center of the gas-liquid separating impeller 8 is communicated with the sub-pump suction port c through the communication hole 6a formed in the center of the main shaft 6 as exemplified in FIG. 4, but may be communicated suitably through a communication hole formed in a periphery of the part where the respective impellers are engaged with the main shaft 6 or through a degassing pipe erected on the suction side of the gas-liquid separating impeller 8 and a communication hole formed in the spacer plate 3.

When the pump apparatus according to the fourth embodiment is actuated, the pumped liquid is conveyed by the pumping of the primary pump 1 along the path from the gas-liquid separating impeller 8, the primary pump suction port a and to the primary pump discharge port b. Meanwhile, the foams in the pumped liquid are forcedly centrifuged by the rotation of the gas-liquid separating impeller 8, producing a tornado-shaped cavity in the vicinity of the center of the gas-liquid separating impeller 8. The tornado-shaped cavity is prevented by the cavity receiver 10 from extending the tail bottom to be drawn into the primary pump impeller. The gas in the cavity is drawn by the vacuum means 12 via the communication hole 6*a* in the vicinity of the center of the tornado-shaped cavity and the sub-pump 4. When foams remain in the pumped liquid, unseparated by the gas-liquid separating impeller 8, a cavity is again produced in the vicinity of the center of the primary pump impeller 2, and the gas in the cavity is also drawn into the vacuum means 12 via the sub-pump 4.

When the pumped liquid is mixed into the gas directed to the sub-pump 4, the sub-pump impeller 5 having a discharging ability (centrifugal force) which can cope with a suction force (vacuum degree) of the vacuum means 12, will be able to immediately perform the gas-liquid separation, and the liquid is returned to the suction side of the primary pump 1 from the discharge port d thereof and through the return path e while the gas in the cavity produced in the vicinity of the center of the sub-pump impeller 5 is drawn into the vacuum means 12. Thus, during the operation, none of the pumped liquid goes into the degassing path h. The vacuum means 12 is accordingly safe, and can be sufficiently powerful.

The gas-liquid separation is performed by the gas-liquid separating impeller 8 and also by the primary pump impeller 2, and furthermore, the pumped liquid mixed in the removed gas can be separated by the sub-pump 4, whereby the defoaming using the vacuum means can be highly efficient. Because of the above-described constitution, the pump apparatus according to the present invention also has high self-priming achievement.

The pumped liquid is subjected to the gas-liquid separation forcedly by the gas-liquid separating impeller 8, but it is of course more preferable that the flow path on the suction side of the gas-liquid separating impeller 8 is arranged to let the liquid to be drawn in along the rotating direction of the gas-liquid separating impeller 8. FIG. 4 shows the flow path on the suction side which is so arranged.

Then, mechanisms provided in the degassing path h in FIG. 4 will be explained.

In the degassing path h from the sub-pump 4 to the vacuum means 12 there are serially inserted a delayed operating valve 13 which is opened at a lag from a time when an operating power of the sub-pump 4 is injected, and a quick valve 14 which is closed immediately at a time when the operating power of the sub-pump 4 is shut off. The delayed opening valve operation of the delayed operating valve 13 prevents the pumped liquid on the side of the primary pump 1 from being drawn into the vacuum means 12 at the instance of actuating the pump, and the quick valve closing operation of the quick valve 14 prevents the pumped liquid on the side of the primary pump 1 from being drawn into the vacuum means 12 or operational fluid of the vacuum means 12 from being drawn to the side of the primary pump 1 at the instance of the power of pump being shut off. In FIG. 4, to simplify the explanation, both the delayed operating valve 13 and the quick valve 14 whose on-off timings are electrically controlled (the control unit not shown) are exemplified. It is possible to replace the delayed operating vale 13 and the quick valve 14 by a single vale which is controlled to be opened at a lag and is instantaneously closed.

FIG. 4 exemplifies, as additional protection means for further safety, a float valve 16 and a liquid reservoir 15 for permitting the gas to pass but prohibiting the liquid from passing inserted in the degassing path h.

The float valve 16 is exemplified by the generally used one that is closed by buoyancy of a float. The float valve 16 forcedly closes the degassing path h at any time throughout the actuation, operation and stop of the pump when a liquid surface on the side of the sub-pump 4 rises. The liquid reservoir 15 is exemplified by the liquid reservoir shown in FIG. 1 which is further simplified. The liquid reservoir 15 has an inlet k and an outlet m provided at upper parts thereof. Liquid which has intruded into the liquid reservoir 15 from the sub-pump 4 or the vacuum means 12 stays at the bottom of the vessel while gas alone is permitted to pass. In an emergency that the above-described unit of the operational mechanisms is inoperatively damaged, these additional protection means prohibit the liquid in the degassing path h from passing, for perfect safety of the apparatus. The delayed operating valve 13, the quick valve 14, the float valve 16 and the liquid reservoir 15 make the respective effective functions, and all of them may not be provided.

In the present fourth embodiment as well as the first embodiment, the discharge port j of the vacuum means 12 is communicated with the discharge side of the primary pump 1 through a return path u indicated by the dot line in FIG. 4 (via booster means 24 if necessary), whereby the pump apparatus can be used in, after the defoaming and the pumping, mixing back the foams into the pumped liquid to cause the pumped liquid to restore its original state.

The rest constitution and the functions are the same as those of the first embodiment, and their explanation will not be repeated.

Figure 5:
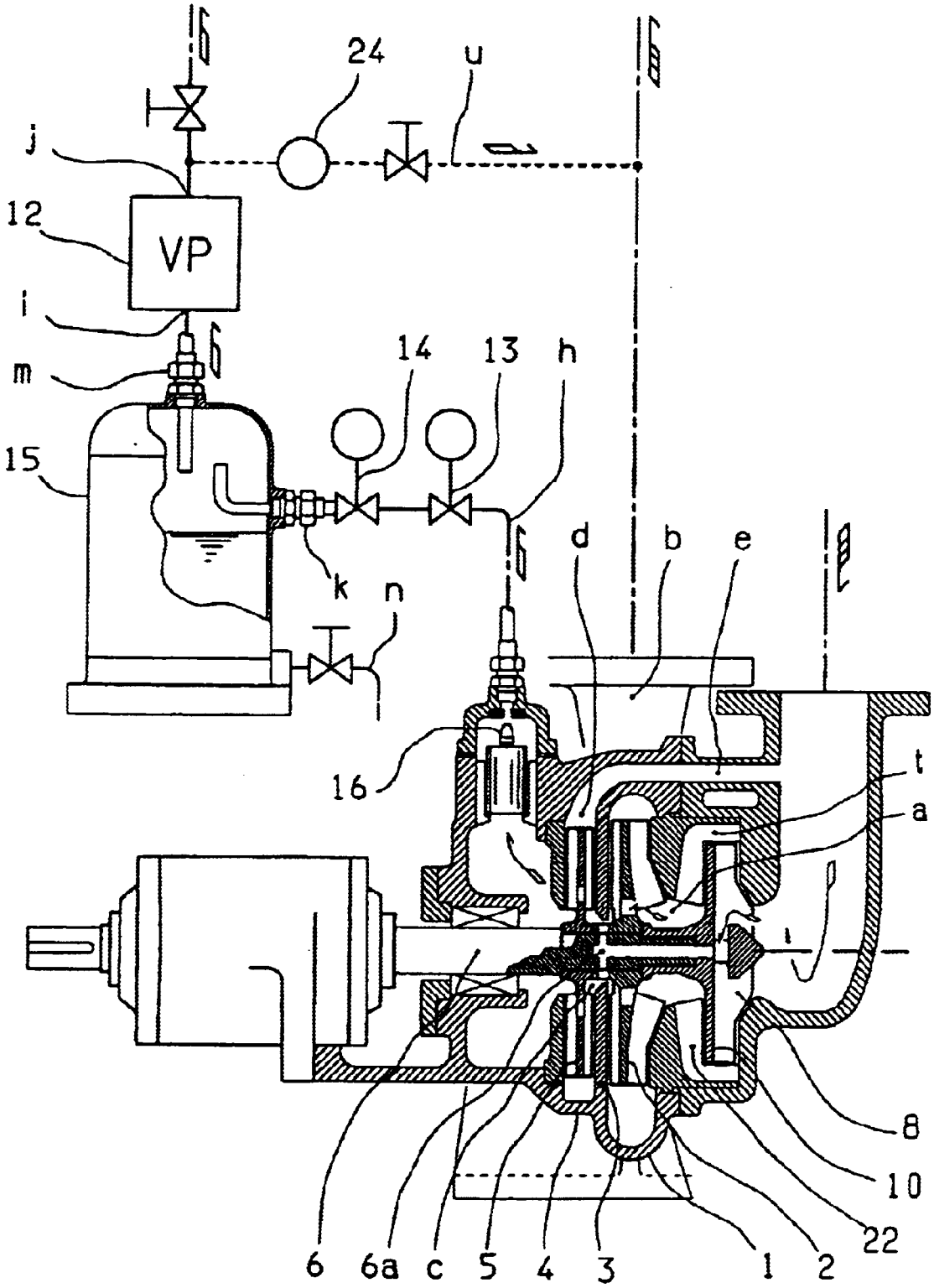
FIG. 5 is a vertical sectional view (partially a side view) of the pump apparatus according to a fifth embodiment of the present invention.

A fifth embodiment shown in FIG. 5 exemplifies an application of the pump apparatus according to the present invention, in which the gas-liquid separating impeller 8 of the fourth embodiment has an increased outer diameter as one means for further improving the gas-liquid separating achievement thereof. In this case, it is more effective to provide a suitable flow guide so that the pumped liquid powerfully pressed on the inside wall of the flow path by a centrifugal force generated by the rotation of the gas-liquid separating impeller 8 can be smoothly drawn into the primary pump inlet against the centrifugal force. The flow guide 22 can be of groove type or vane type. In FIG. 5, the flow guide 22 is exemplified by a vane-type guide.

A cap-shaped member as shown is mounted at the center of the gas-liquid separating impeller 8 at the suction side, whereby conveniently no blind spot where the centrifugal force is not exerted to the pumped liquid takes place.

The rest constitution and functions are the same as those of the fourth embodiment, and their explanation will not be repeated.

Figure 6:
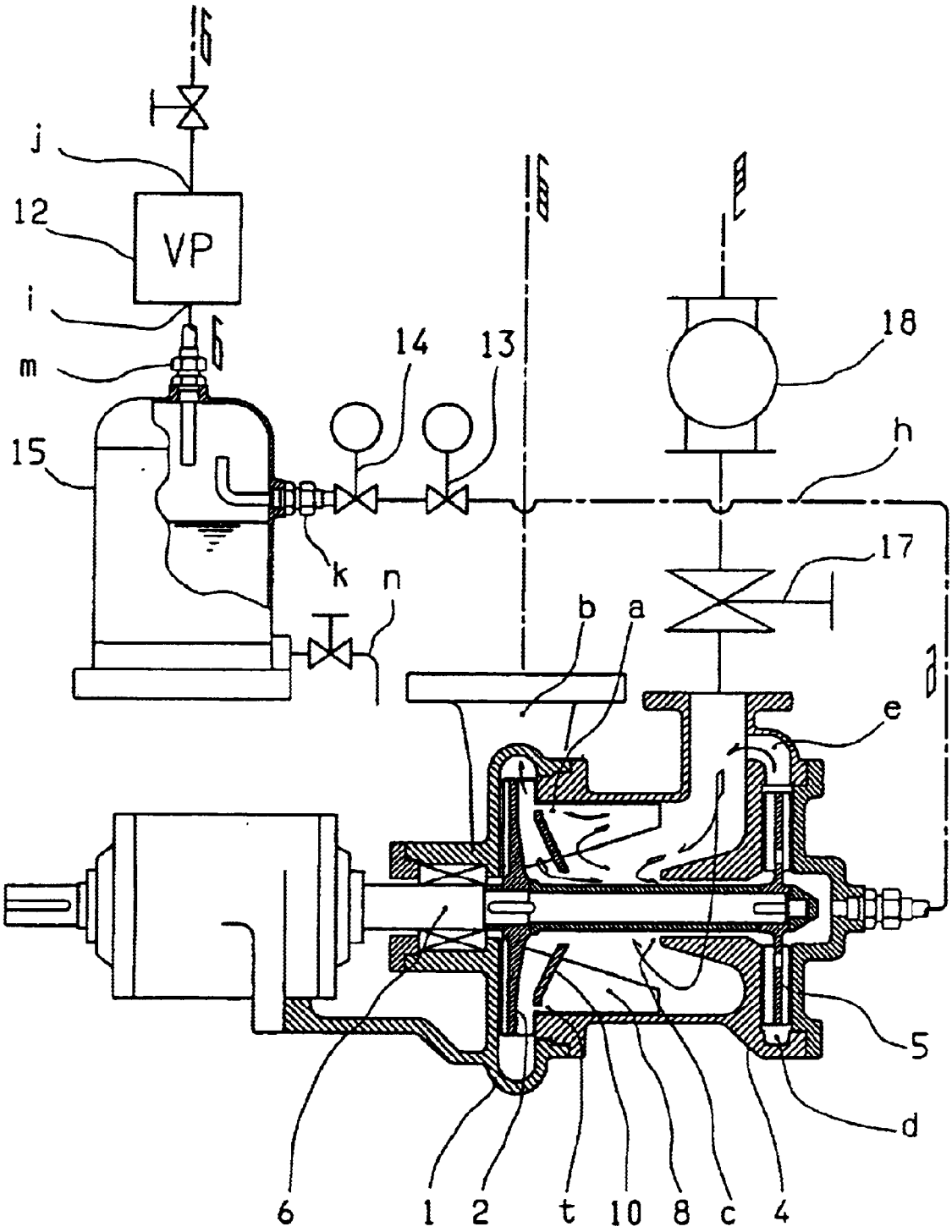
FIG. 6 is a vertical sectional view (partially a side view) of the pump apparatus according to a sixth embodiment of the present invention.

A sixth embodiment shown in FIG. 6 is an application of the pump apparatus according to the present invention to a degassing pump. Throttle means 17 for decompressing the pumped liquid is inserted in the flow path of the gas-liquid separating impeller 8 of the fifth embodiment on the suction side, and foams separated from the pumped liquid by the decompression are forcedly centrifuged by the gas-liquid separating impeller 8.

In the general constitution, the gas-liquid separating impeller 8 and a cavity receiver 10 are formed integral with a primary pump impeller 2 on the suction side, and a sub-pump 4 is provided on the suction side of the gas-liquid separating impeller 8. Thus, a more compact pump apparatus is exemplified.

The throttle means 17 may be of fixed opening type but more preferably is of adjustable opening type as shown. It is exemplified that heating means 18 for the pumped liquid F is inserted in the path on the suction side of the gas-liquid separating impeller 8.

The rest constitution and functions are the same as those of the fifth embodiment and the second embodiment, and their explanation will not be repeated.

Figure 7:
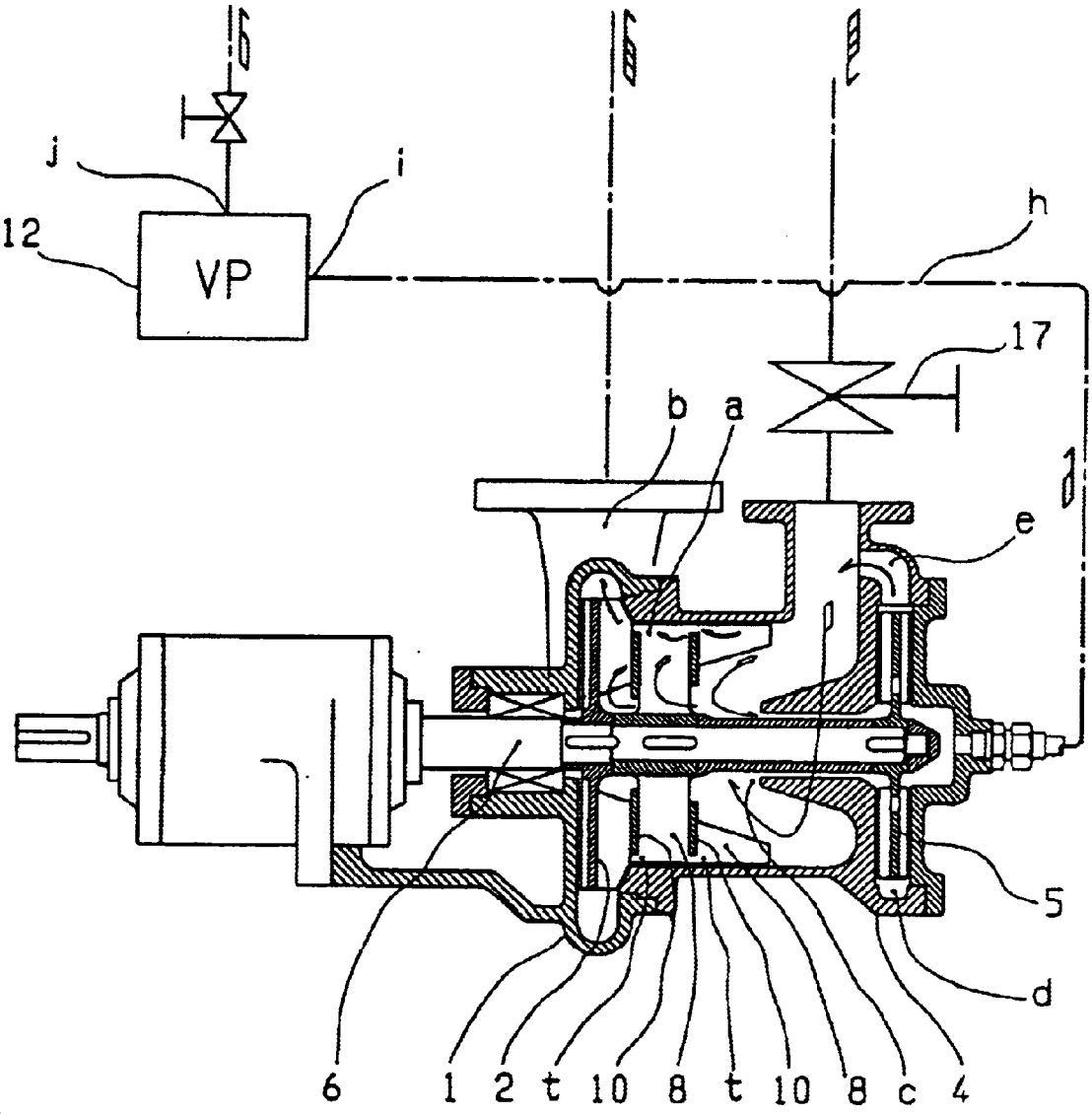
FIG. 7 is a vertical sectional view (partially a side view) of the pump apparatus according to a seventh embodiment of the present invention.

A seventh embodiment shown in FIG. 7 exemplifies an application of the pump apparatus according to the present invention, in which the gas-liquid separating impeller 8 and the cavity receiver 10 of the sixth embodiment are arranged in multi-stages, this example being two stages-type. The gas-liquid separation is performed on totally three stages also including the primary pump impeller 2 so as to increase chances to trap the foams. Although not shown, any of the gas-liquid separating impeller 8, the cavity receiver 10, the primary pump impeller 2, the sub-pump impeller 5 may of course have more stages.

In the present embodiment, the constitution of the periphery of the degassing path h is exemplified by the simple constitution that the degassing path h is directly communicated with the vacuum means 12 substantially without practical troubles because the sub-pump 4 alone can sufficiently prevent the pumped liquid from intruding into the degassing path h. Of course it is more preferable to provide the protection means of the sixth embodiment in the degassing path h.

The rest constitution and functions are the same as those of the sixth embodiment, and their explanation will not be repeated.

Figure 8:
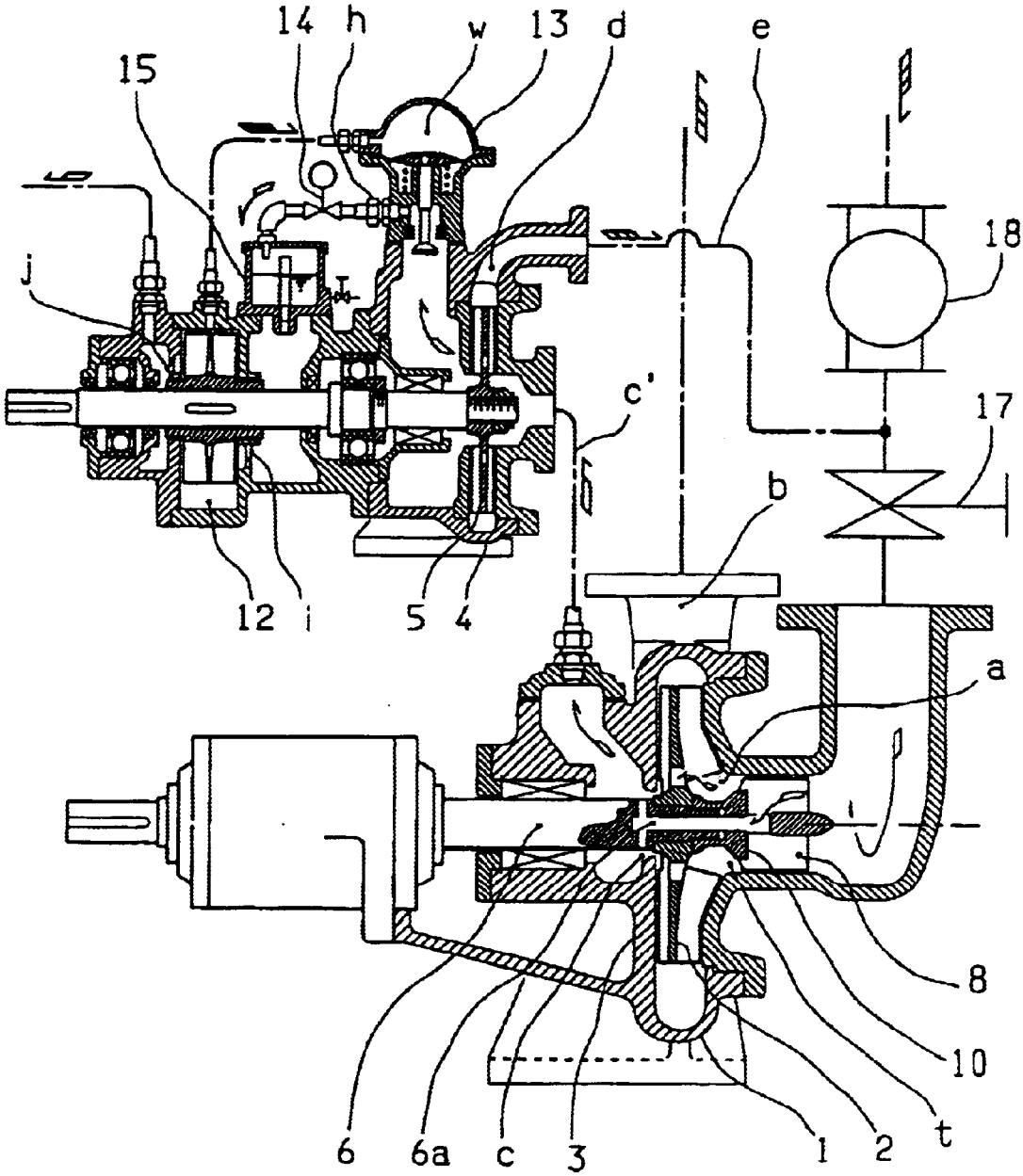
FIG. 8 is a vertical sectional view (partially a side view) of the pump apparatus according to an eighth embodiment of the present invention.

An eighth embodiment shown in FIG. 8 exemplifies another application to a degassing pump. Throttle means 17 for decompressing the pumped liquid is inserted in the flow path of the gas-liquid separating impeller 8 according to the fourth and the fifth embodiments on the suction side so that the foams separated in the pumped liquid by the decompression are forcedly centrifuged by the gas-liquid separating impeller 8.

It is exemplified that a sub-pump 4 may be mounted on the same rotary shaft as vacuum means 12, and an inlet c'may be communicated with a primary pump 1.

In the present embodiment, the vacuum means 12 is a liquid ring vacuum pump 12, and the electric delayed operating valve 13 is replaced with a hydraulic one. The structure of the delayed operating valve 13 is based on the structure described in the specification of the laid-open publication of Original Invention 3. An internal pressure of the valve drive chamber w of the delayed operating valve 13 gradually rises as a hydraulic pressure of the operational fluid of the liquid ring vacuum pump 12 rises, whereby the delayed operating valve 13 is opened after a set period of time. The delayed operating valve 13 may be combined with the function of a quick valve 14 so as to make a single valve which is opened at a time lag and instantaneously closed. This is detailed in the specification of the laid-open publication of Original Invention 3, and its explanation will be omitted. In the present embodiment, a liquid reservoir 15 is directly connected to the suction side i of the vacuum pump 12. The operational principle and the structure of the liquid ring vacuum pump 12 are known, and their explanation will be omitted.

The rest constitution and functions are the same as those of the fourth and the fifth embodiments and the second embodiment, and their explanation will not be repeated.

Figure 9:
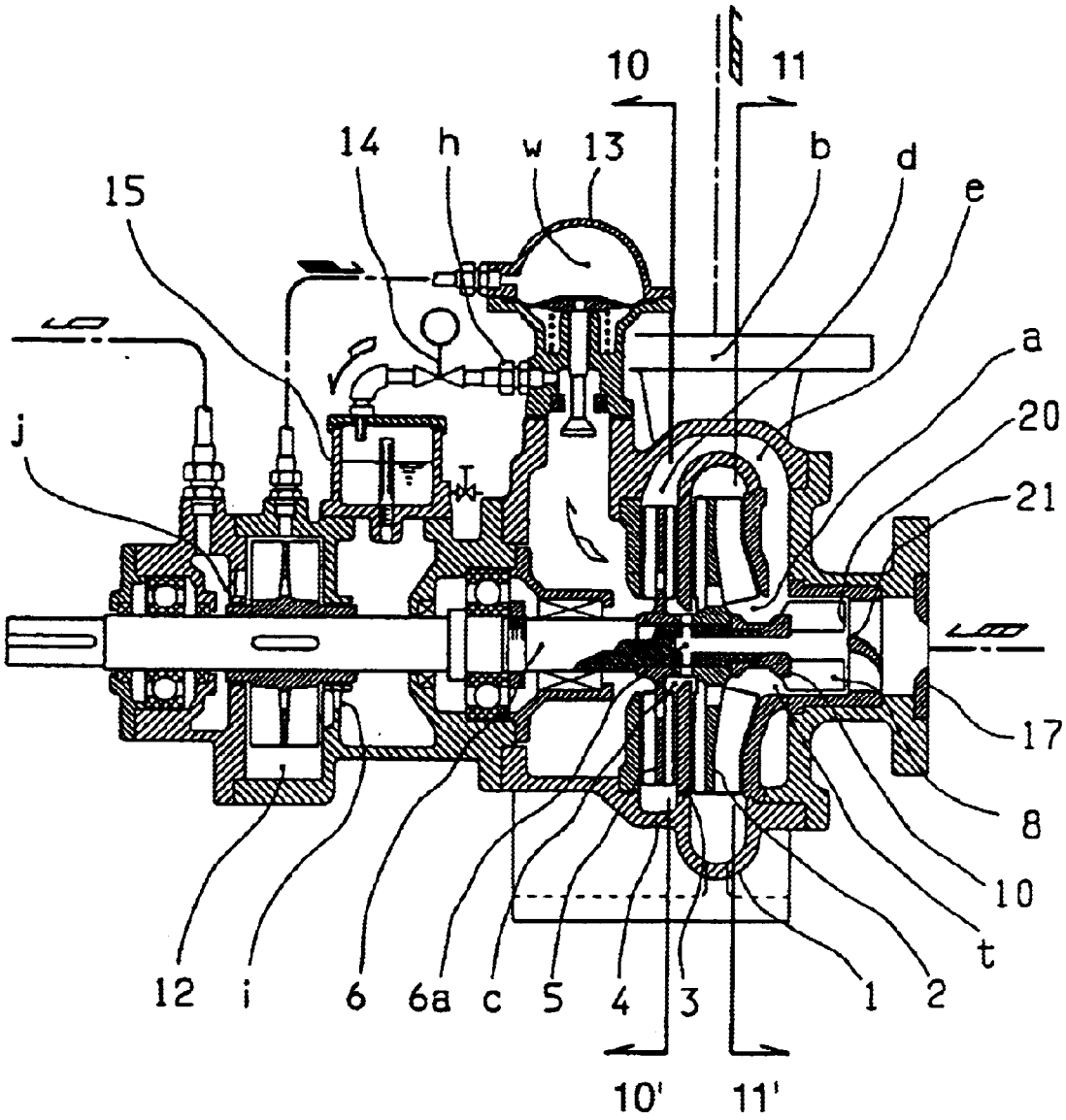
FIG. 9 is a vertical sectional view (partially a side view) of the pump apparatus according to a ninth embodiment of the present invention.
Figure 10:
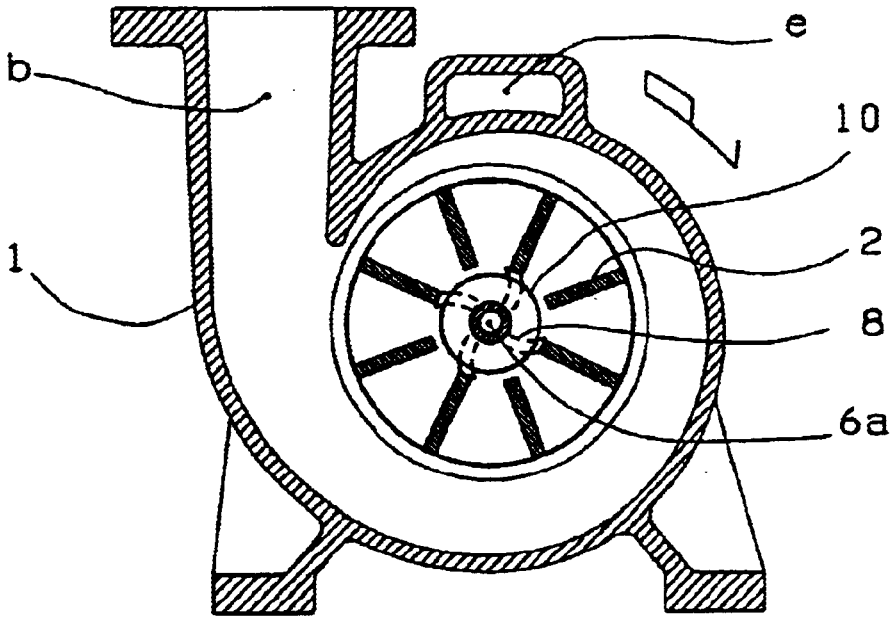
FIG. 10 is a sectional view along the line 11–11' in FIG. 9.
Figure 11:
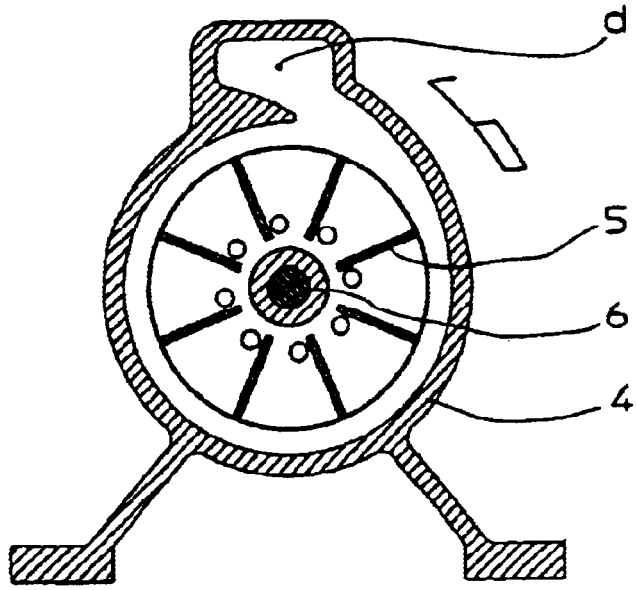
FIG. 11 is a sectional view along the line 10–10' in FIG. 9.
Figure 12:
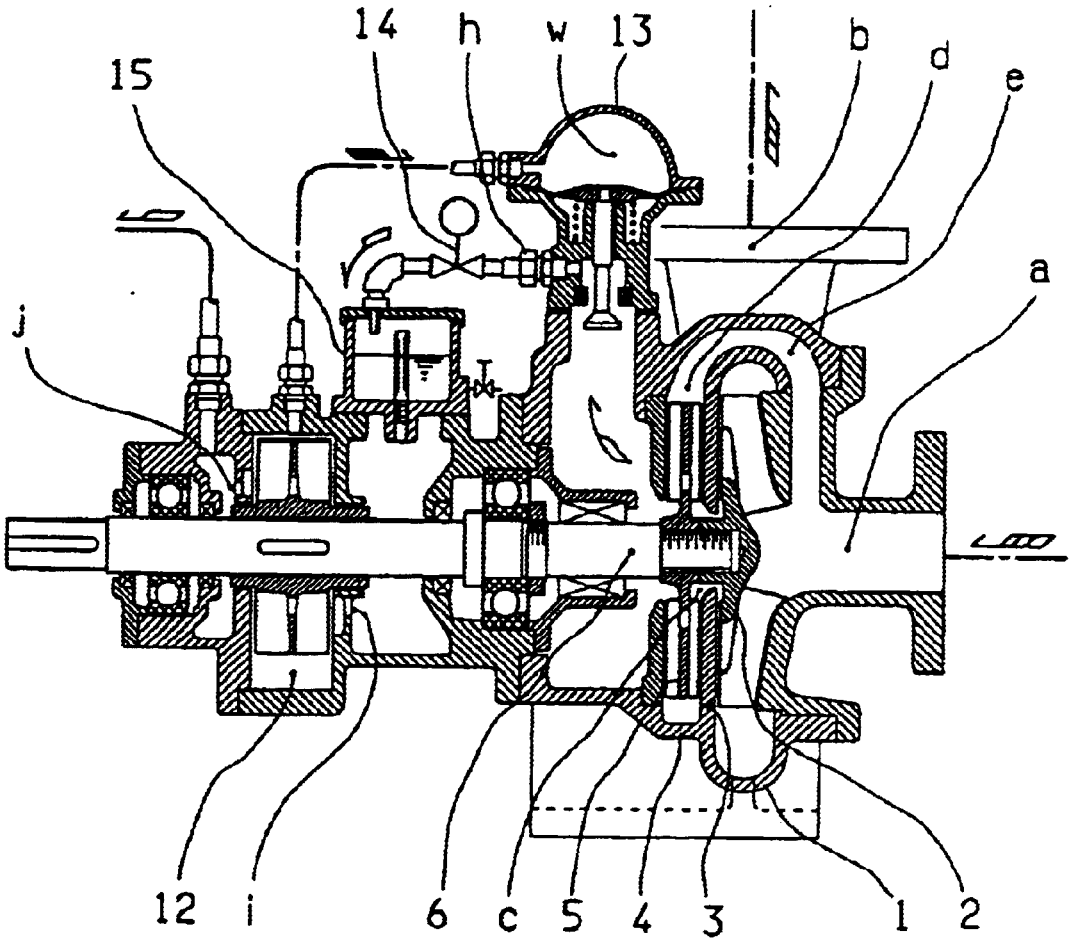
FIG. 12 PRIOR ART
FIG. 12 is a vertical sectional view (partially a side view) of an example of the prior art.
Figure 13:
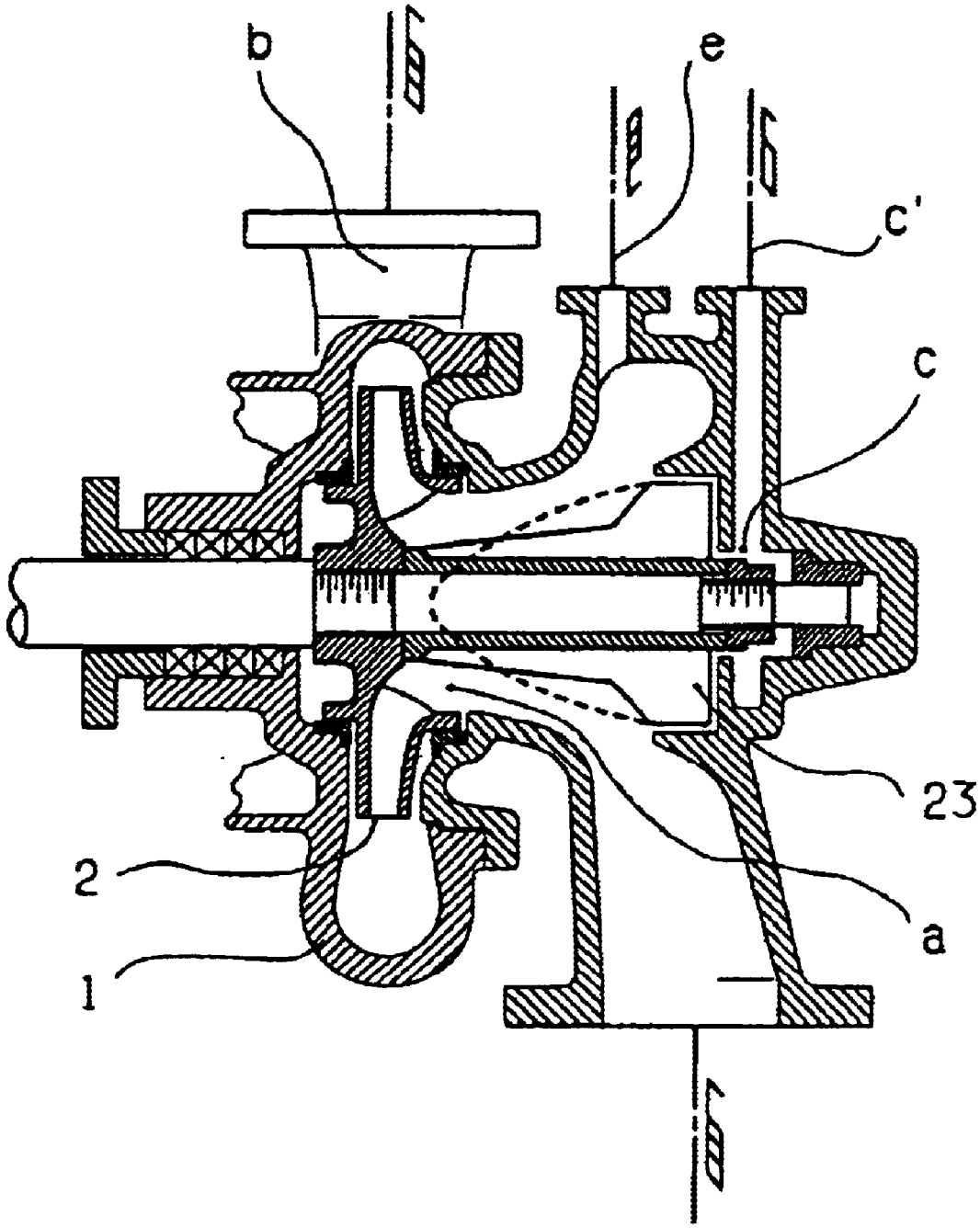
FIG. 13 PRIOR ART
FIG. 13 is a vertical sectional view of an example of the prior art.

A ninth embodiment shown in FIG. 9 exemplifies one application to a pump apparatus having sterilizing function, etc. The pump apparatus has a mechanism for causing cavitation in addition to the pump apparatus according to the eighth embodiment. The general constitution is exemplified by a compact apparatus including a primary pump 1, a gas-liquid separating impeller 8, a sub-pump 4 and vacuum means 12 all arranged on the same rotary shaft. FIG. 10 is a sectional view along the line 11–11' in FIG. 9 and FIG. 11 is a sectional view along the line 10–10' in FIG. 9. They show one example of configurations of the primary pump impeller 2, the gas-liquid separating impeller 8 and the sub-pump impeller 5.

As means for causing the cavitation, cavitation causing means, as of ultrasonic wave generating type, may be disposed in the pumped liquid flow path, but the ninth embodiment exemplifies a constituent member of the primary pump 1, specifically the primary pump impeller 2 formed in a configuration suitable to cause the cavitation. An impeller which tends to cause the cavitation is an impeller which tends to cause pressure changes due to vortexes and turbulent flows. For example, local concavities and convexities, rough surfaces and non-streamlined section of the vanes are factors for the suitable configuration. In the present embodiment, as one example, flat plate-shaped vanes are mounted on the primary pump impeller 2. It is more preferable to form the flat plate-shaped vanes in a configuration which tends to cause more vortexes or turbulent flows by providing concavities and convexities or holes on in the surfaces or forming in a comb-shape or a mesh-shape.

Causing cavitation at a position which is apart from a vane surface and at the downstream is called "super cavitation". In the super cavitation, substantially no cavitation damage occurs to the vanes surfaces. It is also preferable that the primary pump impeller 2 is of the super cavitation vane type. As the super cavitation type vanes, in addition to the above-described flat plate type, various shapes, such as wedge-shape, etc., can be used.

The gas-liquid separating impeller 8 may be formed in a configuration suitable to cause the cavitation and further may be of the super cavitation vane type.

In FIG. 9 showing the present embodiment, furthermore, breaking means for breaking foreign objects-mixed in the pumped liquid is exemplified by a rotary cutter 20 which is disposed upstream of the gas-liquid separating impeller 8 coaxially therewith, and a stationary cutter 21 cooperatively disposed on the side of the casing. Thus, when foreign objects, which cause clogging, such as fibers, masses, cloggy materials, weeds and moss, other living organisms, etc., are mixed in the pumped liquid, the pumped liquid can be conveyed while the foreign objects are being broken. Of course, a strainer for trapping the foreign objects may be used in place of the breaking means, or both may be used.

The rest constitution and functions are the same as those of the eighth embodiment and the third embodiment, and their explanation will not be repeated.

Then, technical matters which are common to the respective embodiments will be explained.

The throttle means 17 can be suitably a (fixed or variable) orifice or various valves as long as they are suitable for the use, and may be disposed in a plural number. An actuator may be mounted for remote control. The heating means 18 may be suitably of heater type or heat-exchanger type.

The primary pump impeller 2 can be of any known type, e.g., non-clogging type, open type, semi-open type, closed type or others. The gas-liquid separating impeller 8, the cavity receiver 10 and the sub-pump impeller 5 can be of any known type, and can have increased outer diameters and be provided in a plural number so as to make the gas-liquid separation effective. The primary pump impeller 2 and the gas-liquid separating impeller 8, or the primary pump impeller 2 and the sub-pump impeller 5 can be respectively integrated with each other so as to make the pump apparatus compact.

The return path e between the outlet d of the sub-pump 4 and the suction side of the primary pump 1 may be cast in one-piece with the pump casing or may be provided in the form of a separate pipe.

The vacuum means 12 can be suitably known means and may be one or provided in a plural number. The vacuum means 12 may be branched to have arbitrary vacuum means added.

The primary pump 1, the gas-liquid separating impeller 8, the sub-pump 4 and the vacuum means 12 may be mounted on the same rotary shaft, or any of the members may have different rotary shaft units. Needless to say, the respective members may be combined and arranged in suitable combinations and arrangements other than those described above.

The technical idea of the present invention is of course applicable to pump apparatuses having the primary pump 1 in the form of types other than the centrifugal pump, e.g., a mixed flow pump, an axial flow pump, a vortex pump, a diaphragm pump, a gear pump or others.

Furthermore, the respective constituent members of the present invention can have within the intended scope of the present invention, design changes such as changes of numbers, positions and arrangement orders of the constituent members, uses of conventional art, etc. Furthermore, material qualities of the constituent members may be suitably selected. Thus, the present invention is not limited to the above-described embodiments.

INDUSTRIAL APPLICABILITY OF THE INVENTION

The present invention provides a multipurpose pump apparatus of high achievement by improving a pump apparatus which can continuously pump and convey even liquid containing a large amount of foams by giving it compact constitutions and incoporating the gas-liquid separating mechanisms, etc. which can operate stably and without failure, whereby the pump apparatus can make high-level defoaming function and degassing function, and furthermore the pumped liquid sterilizing function, small living organisms removing function, impurities breaking function, foreign object breaking function, etc. The pump apparatus is free from troubles due to intrusion of the pumped liquid into the vacuum means and durable, can be completely automatically operated and accordingly requires no labor for the control, can be small-sized or large-sized, and is very economical in equipment and control costs. The practical effects of the pump apparatus are very high.

What is claimed is:

1. A pump apparatus comprising a gas-liquid separating apparatus with a gas-liquid separating impeller being inserted in a pumped liquid flow path of a primary pump for liquid pumping; a cavity receiver receiving the tail bottom of a tornado-shaped cavity produced by rotation of the gas-liquid separating impeller to prevent the tornado-shaped cavity from extending; and vacuum means connected to a part in a vicinity of the center of the tornado-shaped cavity through a degassing path.

2. The pump apparatus according to claim 1, wherein a flow path on the suction side of the gas-liquid separating impeller is formed in a shape by which a liquid is drawn into a direction of rotation of the gas-liquid separating impeller.

3. The pump apparatus according to claim 1, wherein throttle means for decompressing a pumped liquid is inserted in the flow path on the suction side of the gas-liquid separating impeller.

4. The pump apparatus according to claim 1, wherein heating means for a pumped liquid is inserted in the flow path on the suction side of the gas-liquid separating impeller.

5. The pump apparatus according to claim 1, wherein cavitation causing means is disposed in the pumped liquid flow path.

6. The pump apparatus according to claim 1, wherein constituent members of the primary pump are formed in a configuration which tends to cause cavitation.

7. The pump apparatus according to claim 1, wherein the gas-liquid separating impeller is formed in a configuration which tends to cause the cavitation.

8. The pump apparatus according to claim 1, further comprising breaking means for breaking foreign objects in the pumped liquid.

9. The pump apparatus according to claim 1, wherein protection means which allows gas to pass but prevent liquid from passing is inserted in the degassing path.

10. The pump apparatus according to claim 1, wherein a sub-pump including an impeller is disposed; the degassing path is in communication with the suction port of the sub-pump; the discharge port of the sub-pump is in communication with the suction side of the primary pump through a return path; and a part in a vicinity of the center of the sub-pump impeller is in communication with the vacuum means.

11. The pump apparatus according to claim 10, wherein valve means which is opened at a lag from a time when an operating power of the sub-pump is injected and closes immediately at a time when the driving force of the sub-pump is shut off is inserted in the degassing path.

12. The pump apparatus according to claim 10, wherein at least two of the primary pump, the gas-liquid separating impeller, the sub-pump and the vacuum means are coaxial with one rotary shaft system.

13. The pump apparatus according to claim 1, wherein the discharge port of the vacuum means is in communication with the discharge side of the primary pump through a return path.

14. The pump apparatus according to claim 1, wherein the gas-liquid separating impeller and the cavity receiver are disposed in multi-stages.

15. The pump apparatus according to claim 1, wherein at least two of the primary pump, the gas-liquid separating impeller, and the vacuum means are coaxial with one rotary shaft system.

16. A pump apparatus comprising a gas-liquid separating impeller disposed in a pumped liquid flow path of a primary pump for liquid pumping with a primary pump impeller; a cavity receiver receiving the tail bottom of a tornado-shaped cavity produced by rotation of the gas-liquid separating impeller to prevent the tornado-shaped cavity from extending; and vacuum means connected to a part in a vicinity of the center of the tornado-shaped cavity through a degassing path.

17. The pump apparatus according to claim 16, wherein a part in a vicinity of the center of the primary pump impeller is also connected to the vacuum means through a degassing path.

18. The pump apparatus according to claim 17, wherein the primary pump impeller and the gas-liquid separating impeller are disposed adjacent to each other.

19. The pump apparatus according to claim 16, wherein the primary pump impeller and the gas-liquid separating impeller are disposed adjacent to each other.

* * * * *